United States Patent [19]

Tremoulet, Jr.

[11] Patent Number: 5,037,276

[45] Date of Patent: Aug. 6, 1991

[54] HIGH PRESSURE PUMP VALVE ASSEMBLY

[75] Inventor: Olivier L. Tremoulet, Jr., Edmonds, Wash.

[73] Assignee: Flow International Corporation, Kent, Wash.

[21] Appl. No.: 333,560

[22] Filed: Apr. 4, 1989

[51] Int. Cl.[5] ..... F04B 39/10

[52] U.S. Cl. ..... 417/567; 417/470; 137/312; 137/512.3

[58] Field of Search ..... 417/567, 569, 570, 455; 137/312, 512.3

[56] References Cited

U.S. PATENT DOCUMENTS

| | | | |
|---|---|---|---|
| 1,628,096 | 5/1927 | Worth | 417/567 |
| 1,991,460 | 2/1935 | Herzmark | 417/567 |
| 3,045,606 | 7/1962 | Schmidt | 417/569 |
| 3,106,169 | 10/1963 | Prosser et al. | 417/569 |
| 3,260,217 | 7/1966 | Thresher | 417/567 |
| 3,309,013 | 3/1967 | Bauer | 417/567 |
| 3,811,801 | 5/1974 | Buse et al. . | |
| 3,915,461 | 10/1975 | Gautier . | |
| 4,277,229 | 7/1981 | Pacht . | |
| 4,412,792 | 11/1983 | LaBorde et al. . | |
| 4,432,386 | 2/1984 | Pacht . | |
| 4,456,439 | 6/1984 | Wolff . | |
| 4,534,711 | 8/1985 | Wakatsuki . | |
| 4,541,779 | 9/1985 | Birdwell . | |
| 4,551,077 | 11/1985 | Pacht . | |
| 4,572,056 | 2/1986 | Funks . | |
| 4,573,886 | 3/1986 | Maasberg et al. . | |
| 4,716,924 | 1/1988 | Pacht . | |

*Primary Examiner*—Leonard E. Smith
*Assistant Examiner*—Eugene L. Szczecina, Jr.
*Attorney, Agent, or Firm*—Hughes & Multer

[57] ABSTRACT

A high pressure fluid pump having a reciprocating piston which pumps fluid through a central passageway in a valve body of a valve assembly. The valve body forms with an end section of the housing a high pressure fluid chamber axially aligned with the piston. The effective pressure area in the valve chamber acting on the valve body is greater than the effective pressure area acting on the valve body from the cylinder chamber in which the piston reciprocates, so that a net rearward force is exerted on the valve body. There are forward and rear seal members around the valve body which are caused to come into sealing engagement due to fluid pressure in the valve chamber.

46 Claims, 3 Drawing Sheets

HIGH PRESSURE PUMP VALVE ASSEMBLY

BACKGROUND OF THE INVENTION

1. Field of the Invention

The present invention relates to high pressure pumps, and more particularly to a valve and seal assembly incorporated in such pumps.

2. Background Art

There are various applications for high pressure pumps, one being to supply very high pressure fluid (e.g., water at a pressure as high as 10,000 PSI to 100,000 PSI) so that this water may in turn be discharged in the form of a high velocity water jet which can be used for cutting, abrading, etc. A common configuration for such a pump is to employ a reciprocating piston which operates in a high pressure cylinder to direct the fluid (generally water, possibly with an additive) to a nozzle, from which the water is then discharged as the high pressure jet. On the pressure stroke, the plunger or piston can generate pressures in excess of 25,000 PSI, while during the intake stroke the pressure in the cylinder chamber is substantially reduced.

There are a number of critical problem areas associated in the design and operation of such a high pressure fluid pump assembly. It is necessary to provide a valve assembly having the appropriate valve components and intake and outlet openings, and also to provide appropriate high pressure seals. The various components of the apparatus are subjected to widely fluctuation pressure levels, and this in turn can cause some of the components to either compress or expand, depending upon the application of the force. This can have a harmful effect not only on the operation of these components, but also their durability.

The following patents were noted in a search of the patent literature, these being as follows:

U.S. Pat. No. 3,811,801 (Buce et al) shows a reciprocating pump where there is a valve assembly axially aligned with the reciprocating plunger. There are bolts 132 which secure the components of the entire assembly to one another, and one of the alleged functions of this invention is that there is not any great fluctuation in the force exerted on the bolts 132. With reference to FIG. 4 this is accomplished in the following manner. There is a discharge passageway 32 which is exposed to constant high pressure, so that the force on the high pressure area beneath the valve member 32 is exerted upwardly (as seen in FIG. 4) against the valve body 38. This would tend to counteract the high pressure in the chamber in which the plunger 102 reciprocates. There is a seal ring 136 which fits between the valve block 38 and the housing 80 which contains the high pressure piston 102, and also a seal ring 60 that fits between the valve body 38 and the cylinder head 14. An examination of the drawing would indicate that the area beneath the valve member 122 is no larger than the effective pressure area of the piston chamber against the valve member 38, so that these forces would essentially balance each other out.

U.S. Pat. No. 4,541,779 (Birdwell) shows a multi cylinder, hydraulically driven, dual arranged mud pump. In FIG. 3 there are shown 2 pumping sections. The upper pumping section in FIG. 3 is such that it draws the mud in through the end opening 88 and discharges it through the central opening 15. The lower piston and cylinder pump section in FIG. 3 does just the opposite in that the mud is drawn in through the opening 15 and discharged through the opening 88. In the lower portion of FIG. 3, there is a central block or member 11 and an end block or member 39 which are connected to each other by the tie rods 13 which would presumably hold these blocks together to form a seal with a replaceable mud pumping liner 57 (the designation 57 appears only in the upper part of FIG. 3, but denotes the inner main cylinder in which the member 66 reciprocates.) It would appear that in the lower pump section of FIG. 3, on the pressure stroke of the piston and valve member 66, the valve 51 would open so that there would be pressure inside the valve chamber. It would further appear that this pressure within the outlet valve chamber would simply be distributed in both forward and rear direction so that there would be no net force directed back toward the cylinder to create a seal.

U.S. Pat. No. 4,573,886 (Massberg et al) shows a high pressure pump where the plunger that reciprocates to create the high pressure is mounted in a sleeve. Further, there is an intake valve and outlet valve, and the flow passages of these two valves are also defined by respective sleeves. These sleeves are spaced inwardly from their housing in a manner that there is an annular gap around each of these sleeves. The high pressure fluid in the fluid chamber passes through radial openings in the sleeve of the outlet valve to pass into the annular gap around the sleeve, thus balancing the hydraulic pressure inside and outside of the sleeves. Also, fluid pressure surrounds the sleeve of the inlet valve and also the sleeve that surrounds the plunger. It is alleged that this creates a longer live for these sleeves since the stress is balanced.

U.S. Pat. No. 4,412,792 (LaBorde et al) discloses a check valve assembly for a high pressure pump having a reciprocating piston, where there is a valve insert 8 having a frusto conical configuration at the middle portion thereof, and this presses against a conically shaped matching surface of a sleeve in which the cylinder reciprocates. The inlet passages that direct the fluid into the high pressure chamber are spaced radially outwardly of the center axis of the valve insert 8 and extend through the valve insert 8. The high pressure passage extends along the center axis of the valve insert 8. In FIG. 5, there is a generally cylindrically shaped fixed member 50 through which there is a high pressure passageway 51. The member 50 is arranged so that it has a loose fit within the bore 29. Thus, high pressure fluid in the passageway 27 extends around the member 50 so that it is subjected to a constant compressive force. Thus, the high pressure forces that are created within the passage 51 on the compression stroke of the plunger are counteracted by the compressive forces around the member 50, thus improving fatigue life. It appears that the member 50 is urged by the high pressure in the passageway 27 so that it presses against the surface 56 and thus creates a seal so that the high pressure fluid in the passageway 57 would not slip by the member 50 and travel back to the pressurizing chamber on the intake stroke of the plunger.

The following patents appear to be less relevant than those discussed above, but will be treated briefly to insure that there is a disclosure of all possibly relevant prior art.

U.S. Pat. No. 4,716,924 (Pacht) shows a high pressure pump having a cylindrical plunger which reciprocates in a cylinder block. This patent is directed particularly to the configuration of the intake and discharge valves.

U.S. Pat. No. 4,432,386 and U.S. Pat. No. 4,277,229 contain the same disclosure as U.S. Pat. No. 4,716,924.

U.S. Pat. No. 4,551,077 (Pacht) shows a high pressure pump where there is a reciprocating plunger that moves along an axis, and an intake and discharge valve assembly which is mounted on the same axis as the plunger. There is an inlet valve 76 which in the seated position closes off a slanted intake passageway 66. There is a discharge passageway 86 which extends through a cylindrical portion 73 that extends axially from the valve seat 76. There is an outlet valve 88 which is positioned beyond the passageway 86 and through which the high pressure fluid is discharged.

U.S. Pat. No. 3,106,169 (Prosser et al) shows a high pressure valve and block assembly where there is a reciprocating piston 15 which discharges through the valve assembly. There are intake passages 29 and an outlet passage 19, with an outlet valve member 41. The purpose of this invention is to relieve the periodic loading on the valve members that results in the high pressure delivery piston stroke of the piston 15 and the low pressure intake stroke. The valve members are arranged so that only the members 51, 53 and 55 are exposed to the radially outward loading of the high pressure fluid going through the passageway 19.

U.S. Pat. No. 4,572,056 (Funke) discloses a plunger type pump where there is a plunger guide bushing made of a ceramic material in which a plunger made of sapphire is slideably guided. The invention resides in the discovery that the use of the hard ceramic material and the sapphire provides a match so that there is little wear.

U.S. Pat. No. 4,534,711 (Wakatsuki) discloses a high pressure pump with a reciprocating plunger. The patent is directed toward a discharge nozzle configuration where the nozzle (and therefore the water jet emitted therefrom) has a rotational motion.

U.S Pat. No. 4,456,439 (Wolff) shows a high pressure pump with a reciprocating plunger. Patentability is predicated upon the overall arrangement of the main components, particularly an L-shaped housing which holds the intake valve and the outlet valve. The inlet valve is axially aligned with the axis along which the plunger reciprocates, and the outlet valve is at right angles thereto. This provides for easy access to both valves.

U.S. Pat. No. 3,915,461 (Gautier) shows a seal for a piston which is used as a brake actuator. Patentability is predicated upon a particular configuration of the seal and groove in which the seal fits in the housing.

SUMMARY OF THE INVENTION

There is a housing structure having a forward end, a rear end, a longitudinal center axis, the housing comprising a rear cylinder section defining a high pressure longitudinally aligned cylinder chamber and a forward end section. A piston is mounted for reciprocating motion in the cylinder chamber on a forward high pressure discharge stroke and a rearward intake stroke.

A valve assembly is mounted at the forward end of the cylinder section and provides at least a fluid outlet leading from said cylinder chamber. This valve assembly comprises a valve body member having a rear portion in sealing engagement with a forward portion of the cylinder section, and a forward portion in sealing engagement with the end section of the housing structure. The valve body and the end section form a high pressure valve chamber located at a forward side of said valve body and arranged to receive high pressure fluid from said cylinder chamber.

The valve body has a forward fluid pressure surface means with an effective first rearwardly acting pressure surface area exposed to pressure from fluid in the valve chamber, and a second rear fluid pressure surface means with an effective second forwardly acting pressure surface area exposed to pressure from fluid in the cylinder chamber. The first rearwardly acting pressure surface area is greater than the second forwardly acting pressure surface area in a manner that a net rearward pressure force is exerted on the valve body to cause the valve body to be urged into sealing engagement with the cylinder section.

In the preferred configuration, there is rear seal member at an interface of the cylinder section and the rear portion of the valve body. The rear seal member has first and second contact surfaces to engage the cylinder section and the valve body, respectively. The contact surfaces are arranged so that a rearwardly directed force on the valve body tends to press the real seal member into sealing engagement between the cylinder section and the valve body. Desirably, at least one of the first and second contact surfaces is slanted at an acute angle with a longitudinal axis. In a preferred configuration the first contact surface of the rear seal member engages a matching slanted contact surface provided at a forward inner edge region of the cylinder section. The second contact surface of the rear seal has at least one surface portion thereof slanted at an acute angle with respect to the longitudinal axis and engages a matching surface of the valve body. In a preferred configuration, the second contact surface has, in cross sectional peripheral configuration, a curved surface configuration which engages a matching curved surface configuration of the rear portion of the valve body.

Desirably, the rear seal is made of a non-galling material which permits limited relative movement at the contact surfaces without substantial galling.

Also, in the preferred configuration, there is a forward seal member located at an interface of the forward portion of the valve body and the end section of the housing structure. The forward seal member is arranged so that fluid pressure in the valve chamber acts on the forward seal member to tend to move the forward seal member into sealing engagement between the valve body and the end section of the housing section. The forward seal member has a forwardly facing effective seal surface area exposed to pressurized fluid in the valve chamber, whereby fluid pressure in the valve chamber exerts a rearward force on the forward seal member to cause said forward seal member to come into effective sealing engagement.

In the preferred form, the forward seal member has first and second contact faces to engage matching contact surface portions of the valve body and the end section, respectively. One of the first and second contact faces is slanted at an acute angle with respect to the longitudinal axis, and in the preferred form this is the first contact face. The valve body has its contact surface portion sloped to match the first contact surface of the forward seal member. Also, the second contact face of the forward seal member faces radially outwardly, and the contact surface portion of the end section faces inwardly to match the second contact surface of the forward seal member. In the specific configuration shown herein, the second contact face of the forward seal member is substantially parallel to the longitudinal axis.

Also, in the preferred configuration, there is a spacing element positioned in the valve chamber and disposed to bear against a forwardly facing surface portion of the forward seal member. The valve body and the end section of the housing are arranged to provide passageway means extending rearwardly from said forward seal member to a low pressure area, so that leakage around the forward seal member can escape through the passageway means. This is desirably accomplished by providing the valve body with a forward facing frustoconical surface which engages the forward seal member and which is spaced from the end section at a location forwardly of the forward seal member to provide the passageway means. Also, the forward seal member is desirably made of a non-galling material to permit limited relative movement between the end section and the valve body without substantial galling.

Another feature of the present invention is that the valve body is formed with an outlet passageway portion leading from the cylinder chamber. The valve assembly comprises a poppet valve element, and an annular poppet seat element positioned forwardly of said poppet valve element, and located in a recess at a forward portion of the valve body. The poppet valve element is positioned against the poppet seat element when the poppet valve element is in its closed position. The poppet seat element has a radially outward surface portion exposed to pressure in the valve chamber, whereby fluid pressure in the valve chamber is able to exert a radially inward compressive force on the poppet seat element to balance radially outwardly exerted fluid pressure forces from within said passageway outlet portion. In the preferred form, the poppet seat element has a generally cylindrical configuration.

Other features of the present invention will become apparent from the following detailed description.

DESCRIPTION OF THE PREFERRED EMBODIMENT

It is believed that a clearer understanding of the present invention will be obtained by describing generally the overall structure and operation of the entire apparatus of the present invention and then describing in more detail the valve and seal assembly which is especially significant in the present invention.

Figure 1:
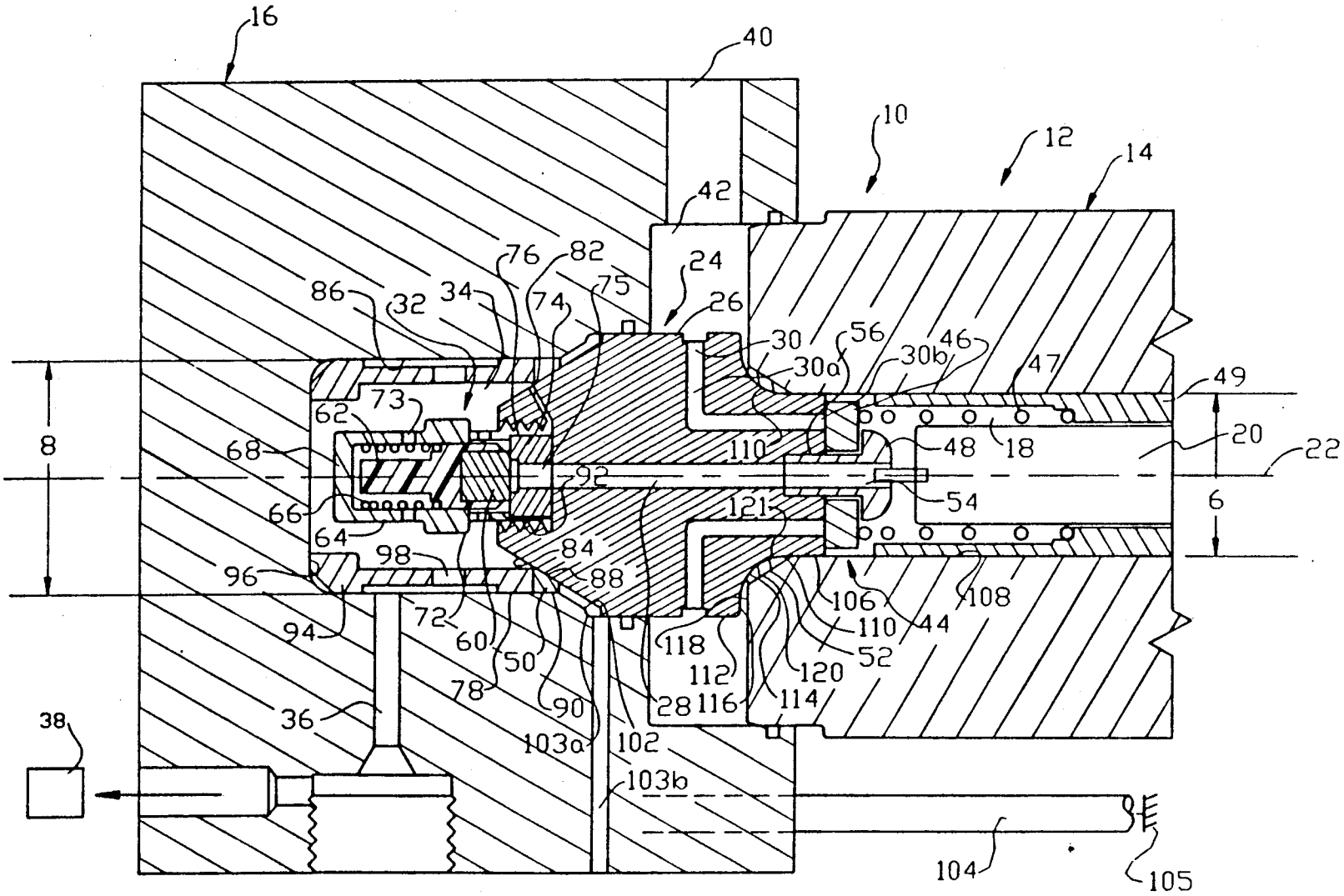
FIG. 1 is a sectional view of the apparatus of the present invention, with the section being taken along the longitudinal centerline of the assembly.
Figure 2A:
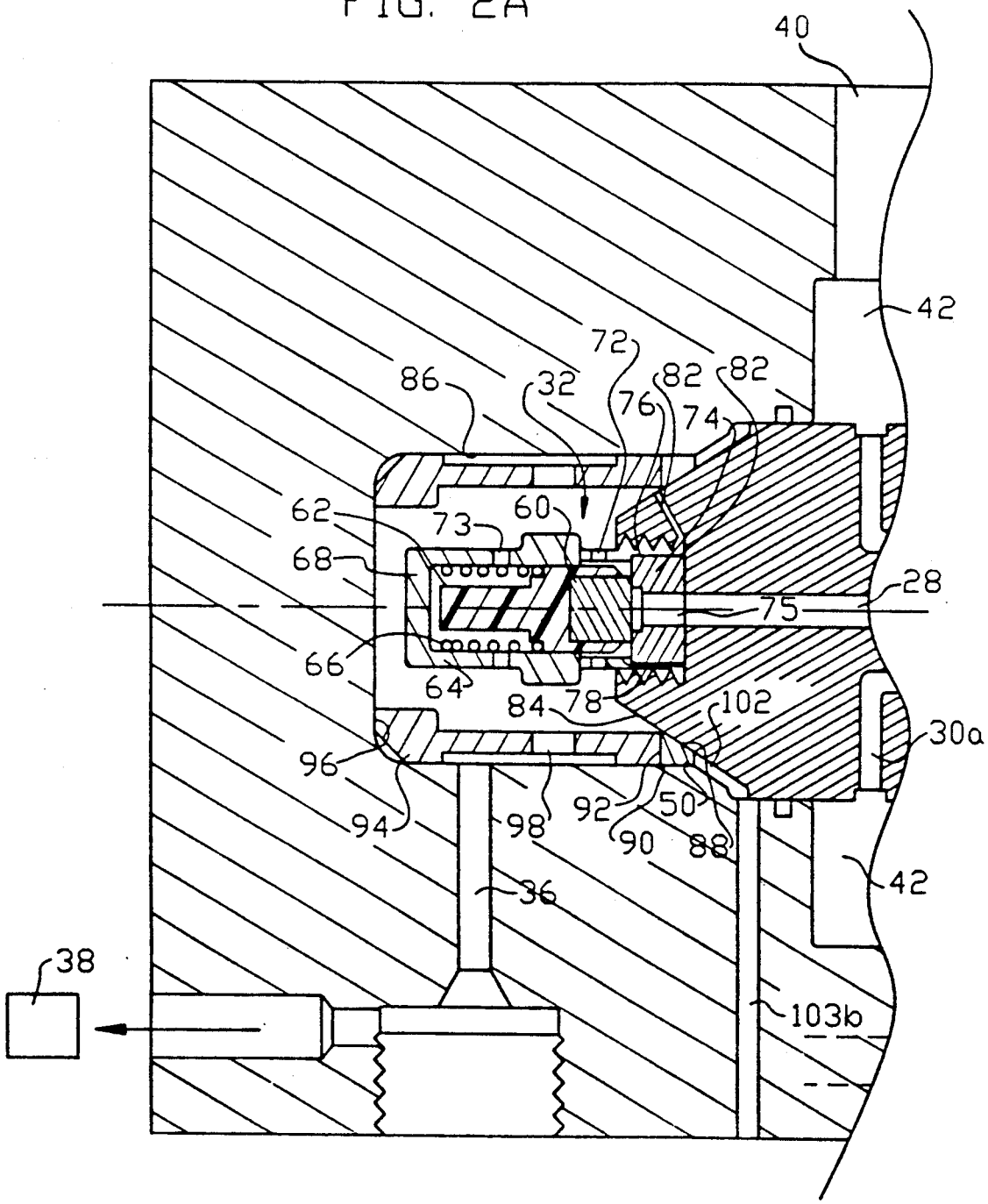
FIGS. 2A and 2B are sectional views taken along the longitudinal centerline draw to an enlarged scale, and showing the forward and rear portions, respectively, of the valve and seal assembly this being done to illustrate the components more clearly and provide a larger scale for proper placement of the numberical designations.
Figure 2B:
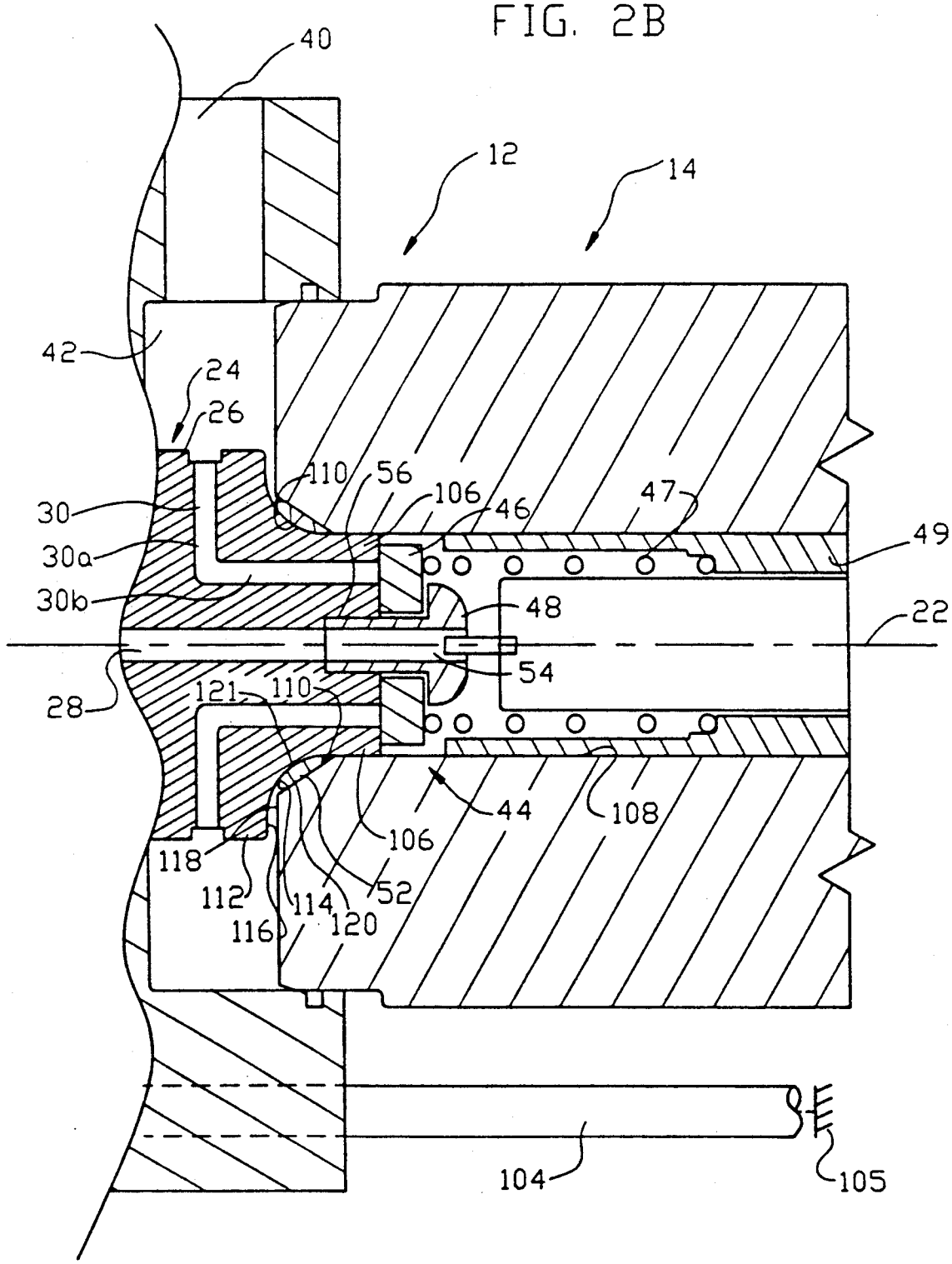

In FIG. 1, only that portion of the apparatus (i.e. pump assembly) is shown which is critical to an explanation of the present invention. The apparatus or pump assembly 10 comprises a housing structure 12 which in turn is made up of a cylinder housing section 14 and an end cap housing section 16. The cylinder housing section 14 (hereinafter called the cylinder 14) defines a cylinder chamber 18 having a generally circular cross sectional configuration in which reciprocates the high pressure plunger or piston 20. For purposes of description, the apparatus 10 can be considered as having a longitudinal center axis 22 which is coincident with the center axis of the cylinders defined by the piston 20 and the cylinder chamber 18. Also, the end portion of the apparatus 10 which is adjacent the end cap 16 will be considered the forward end, while the opposite end of the apparatus will be considered the rear end.

At the front end of the cylinder chamber 18, there is located a valve and seal assembly, generally designated 24. As indicated above, this assembly 24 is particularly critical in the present invention. This assembly 24 comprises a valve body 26 which has a center longitudinally aligned outlet passageway 28 and several inlet passages 30 which are spaced radially from the longitudinal axis 22. The high pressure flow through the outlet passageway 28 passes through an outlet poppet valve 32 into a high pressure valve chamber 34, and thence through the outlet opening 36 formed in the end cap 16 to flow into an accumulator (indicated schematically at 38). An arrangement is contemplated where there would be several such pumping assemblies 10 which supply pressurized fluids sequentially into the accumulator 38 so as to sustain a substantially constant supply of high pressure fluid. Thus, it can be recognized that during operation of the apparatus 10, the high pressure valve chamber 34 will be constantly filled with high pressure fluid.

With regard to the inlet passages 30, there is provided a radially aligned supply passageway 40 formed in the end cap 16, and this flows into an annular passageway area 42 surrounding the middle portion of the valve body 26, to in turn flow into radially aligned inlet passageway portions **30*a*, and thence rearwardly through axially aligned passageway portions 30*b*. There is provided a poppet valve 44 which comprises an annular poppet element 46 which is urged to a closed position by a compression spring 47. There is a retaining screw 48 which permits limited movement of the poppet element 46 so that there can be an inflow of fluid (e.g., water) into the cylinder chamber on the rearward intake stroke of the piston or plunger 20, with the poppet element 46 closing upon the forward pressure stroke of the plunger 20. The spring 47 bears against a shoulder of a spacer or filler tube 49 positioned in the cylinder chamber 18**.

There are two rather critical seals provided in the present invention, one of these being a forward annular seal 50 that forms a seal between the valve body 26 and the end cap 16, and the other being a rear seal 52 which provides a seal between the rear portion of valve body 26 and the forward inner edge portion of the cylinder 14. The structure and function of these seals 50 and 52 in the overall assembly of the present invention are considered to be quite significant, and these will be discussed later herein after there is a more detailed description of the other components of the apparatus 10.

To return to a description of the inlet valve 44, the screw 48 is provided with a center through opening portion 54 which is aligned with, and forms the rear portion of, the longitudinally aligned passageway 28 through the valve body 26. This screw 48 has its forward end formed with threads to threadedly engage a central rearwardly facing socket in the rear central portion of the valve body 26, this threaded connection being indicated at 56. There is a small amount of clearance between the head 58 of the screw 48 and the inlet poppet element 46 to permit the poppet element 46 to have limited movement into and away from closing engagement with the passageway portions 30*b*.

With regard to the outlet poppet valve 32, there is a cylindrical poppet element 60 that is mounted to the rear end of a poppet guide 62 that is in turn mounted within a cage 64. A compression spring 66 is positioned around the forward end of the guide 62 and presses from a front wall 68 of the cage 64 against a shoulder 70 formed at the rear portion of the poppet guide 62. Both the poppet guide 62 and the cage 64 have an overall cylindrical configuration, and the cage 64 is formed with a plurality of first openings 72 to permit high pressure fluid to flow through the outlet passageway 28 and around the poppet element 60, through the openings 72, and into the high pressure valve chamber 34. Vents 73 are provided to permit movement of the poppet guide 62 and poppet element 60.

Positioned within the forward end of the cage 64 is an annular cylindrically shaped insert 74 which forms a valve seat for the poppet element 60. This insert or valve seat 74 is formed with a through opening 75 which in effect defines the front end portion of the valve body outlet passageway 28. The outer cylindrical surface 76 of the valve seat 74 is exposed to the pressurized fluid within the valve chamber so that there is a substantially constant radially inward compressive force exerted around the exterior surface 76 of the valve seat 74. This can conveniently be accomplished by forming a small passage 78 at the adjacent inwardly facing cylindrical surface 80 formed as a socket in the front of the cage 64. Alternatively, there can be provided passage 82 in the valve body 26 which leads from the valve chamber 34 to the area surrounding the outer cylindrical surface 76 of the valve seat 74. It has been found that this arrangement alleviates to a substantial extent the tendency for the substantial pressure fluctuations in the valve body outlet passageway 28 from causing premature failure of the valve seat 74, such as from deterioration from fatigue.

To describe now the forward seal 50, as a preliminary comment, it will be noted that the forward portion of the valve body 26 has a frustoconical configuration which tapers radially inwardly in a forward direction, with the frustoconical surface being indicated at 84. The end cap 16 has an inwardly facing cylindrical surface portion 86 which defines the aforementioned valve chamber 34, with the rear edge of this cylindrical surface portion 86 terminating at a location closely adjacent to the frustoconical surface 84 of the valve body 26. To provide a seal between the interface of the frustoconical surface 84 and the rear portion of cylindrical surface 86, there is provided the aforementioned seal 50. In a cross-sectional configuration taken perpendicular to the circumference of the forward seal 50, this seal 50 has a radially inward frustoconical seal surface 88, the slope of which matches the slope of the frustoconical surface 84 of the valve body 26. The seal 50 has an outer cylindrical surface 90 which fits against the rear portion of the cylindrical surface 86 of the end cap 16. Finally, the seal 50 has a forwardly facing annular surface 92 which is shown herein is aligned transverse to the longitudinal center axis 22. There is a cylindrical annular spacing element 94 which fits just inside the cylindrical wall 86 of the end cap 16, this spacing element 94 bearing against a rearwardly facing surface portion 96 of a forward wall defining the forward portion of the valve chamber 34, with the rear end portion of this spacing element 94 pressing against the forward surface 92 of the seal 50 so as to maintain the seal 50 in its proper position against the surfaces 84 and 86. As shown herein, this spacing element 94 has radial openings 98 which lead into an annular chamber 100 that in turn communicates with the outlet opening 36 formed in the end cap 16. With regard to the function of the seal 50, it can readily be seen that as the valve chamber 34 becomes pressurized, the fluid in the chamber 34 bears against the forward surface 92 of the seal 50 so as to press the seal 50 rearwardly into firm sealing engagement with the frusto-conical surface 84 which in turn expands the seal ring into firm sealing engagement with the cylindrical surface 86 and with the frustoconical surface 84.

At a location immediately rearwardly of the seal 50, the inner surface of the end cap 16 is formed with a short frustoconical portion 102 which is spaced a short distance from the frustoconical surface 84 of the valve body 26. This forms an annular passage 103*a* which is vented to atmosphere by passage 103*b*. The surface 103*b* of the seal 50 exposed to this annular passage 103*b* is not supported and is only exposed to substantially zero pressure. The activating sealing forces on seal 50 can then be seen to be the balance of the fluid pressurized area 92 and the supporting higher bearing stresses on the conical area 88. to assure effective sealing between metal surfaces the contact (bearing) stresses must be higher than the pressure in the fluid to be sealed. The end cap is connected by suitable means to the rest of the overall structure, and this can be accomplished, for example, by tie rods (one of which is shown at 104) and which extend forwardly to connect to housing structure positioned forwardly of the cylinder housing section 14 and indacted schematically at 105.

It will be noted that the diameter of the high pressure area in the valve chamber 34 (which in this configuration is the diameter of the cylinder wall 86 indicated at "a") is moderately greater than the diameter of the cylinder chamber 18 (indicated at "b"). Thus, under circumstances where the pressure in the valve chamber 34 is approximately equal to the pressure in the cylinder chamber 18, since the effective pressure area of the forward surface portions of the valve body 26 and the seal 50 is greater than that of the effective pressure area at the rear of the valve body 26, there is a net rearward force exerted on the valve body 26 to urge it rearwardly toward the cylinder housing 14. The significance of this will become more apparent when we discuss the rear seal 52.

With regard to the specific construction of the seal 50, this is desirably made of a relatively strong material which is capable of withstanding the relatively high pressures to which the seal 50 is exposed from the fluid in the valve chamber 34. However, it should also be recognized that due to the variations in the high fluid pressures in the system, differential forces are exerted which can cause moderate contraction or expansion of the components (e.g., the end cap 16 and the valve body 26), which in turn results at least some small amount of relative motion. Thus, it is desirable that the material at the surface of the seal 50 permit some relative movement without causing galling or other deterioration of the adjacent surfaces in hard contact with each other.

Attention is now directed to the aforementioned rear seal 52. The rear end of the valve body 26 is formed with a reduced diameter rearwardly extending cylindrical portion 106 which fits with reasonable snugness within the forward portion of the inner surface 108 of the cylinder 14 defining the cylinder chamber 18. The forward inner surface portion of the cylinder 18 is formed as a frustoconical surface 110 which tapers inwardly and rearwardly. Also, the transition surface portion by which the rear valve body portion 106 joins to the main central portion 112 of the valve body 26 is configured (in cross-section taken perpendicular to their circumference thereof) as a right angle curve, with this circumferential curved portion being designated 114. This curved surface 114 then blends into a radially outwardly extending annular, forwardly facing surface portion 116 that is spaced a short distance forwardly of an opposed surface portion 118 formed at the forward surface of the cylinder 14.

The rear seal 52 is desirably made of a metal or metal alloy (e.g., brass) which will yield moderately under high loading. Such a material would have the similar antigalling characteristics as previously described for the forward seal 50.

This seal 52 has a radially outwardly facing frustoconical surface 120 which matches the slope of the frustoconical surface portion 110 of the cylinder 14. The seal 52 has a radially inwardly and forwardly facing curved surface portion 121 (i.e., curved in cross-sectional configuration taken transverse to the circumference of the seal 52) that is similar to the configuration of the curved surface portion 114 of the valve body 26, but is formed by a radius about 5% longer than that of 114. To discuss the function of this rear seal 52, it should be recognized that in the initial assembly of the apparatus 10, the valve body 26 and the cylinder 14 are configured, relative to the rear seal 52 so that with the seal 52 fitting snugly against the surface portions 110 and 114, the surfaces 116 and 118 are spaced a short distance from one another (e.g., between 0.01 to 0.02 inch). As discussed previously, with the valve chamber 34 being pressurized, there is a net rearward force exerted by the valve body 26 in a rearward direction. With the surfaces 116 and 118 being spaced from one another, the rearwardly directed force on the valve body 34 is reacted through the seal 52 against the frustoconical surface 110 of the forward portion of the cylinder 14. This creates what can be described as a radially outward wedging action that tends to expand the forward portion of the cylinder 14. With the seal 52 being made of a moderately yielding material, this seal 52 takes something of a permanent set where it exerts a continuous radially outward force on the forward portion of the cylinder 14. It has been found that this arrangement prestresses and thereby significantly reduces what otherwise would be failure in the cylinder region adjacent to the frusto-conical surface 110 due to fatigue because of periodic pressurization of the cylinder chamber 18 upon the pressure stroke of the plunger 20.

To summarize the operation of the present invention, the piston 20 reciprocates in the cylinder chamber 18 on a forward compression stroke during which where fluid in the chamber 18 is pressurized to as high as 10,000 psi and often substantially greater (e.g. up to as high as 100,000 psi or higher). The fluid (usually water) moves through the passageway 28 to move the poppet valve element 60 to the open position, then passes through the openings 72, through the valve chamber 34, through openings 98, into the annular passageway 100 and out the discharge passageway 36 to an accumulator 38. The liquid pressure in the accumulator 38 remains at a nearly constant high pressure level. One manner of accomplishing this is by the use of several pumping assemblies which operate in a sequence to direct fluid into same accumulator 38.

On the intake stroke of the piston 20, the poppet valve element 60 closes, while the intake poppet valve element 46 opens to permit water to flow into the chamber 18 by means of the inlet passageways 30. It can be seen that during the intake stroke the pressure in the valve chamber 34 remains at a high pressure level substantially the same as that in the accumulator 38. This pressure would be nearly the same as the pressure generated in the cylinder chamber 18 on the high pressure stroke of the piston 20.

As indicated previously, the diameter (indicated at "a") of the effective pressure area in the region of the valve chamber 34 is greater than the diameter (indicated at "b") of the effective pressure area in the cylinder chamber 18. Thus, there is a net rearward force exerted on the valve body 26 even during periods of high pressure in the cylinder chamber 18. The pressure in the valve chamber 34 acts on the forward surface 92 of the seal 50 to cause it to come into sealing engagement between the end block 16 and the valve body 26, as described in more detail previously herein in more detail. At the same time, the total rearward force on the valve body 26 causes the rear seal 52 to come into proper sealing engagement between the valve body 26 and the cylinder 14 (this also having been described in detail previously herein.)

The tie rods 104 pull the end block 16 rearwardly to counteract the pressures in the region of the valve chamber 30 which would tend to move the end block 16 forwardly.

It is to be recognized that various modifications could be made in the present invention without departing from the basic teaching thereof.

What is claimed:

1. A high pressure pump assembly comprising:

a. a housing structure having a forward end, a rear end, a longitudinal center axis, and comprising a rear cylinder section defining a high pressure longitudinally aligned cylinder chamber, and a forward end section;

b. a piston mounted for reciprocating motion in said cylinder chamber on a forward high pressure discharge stroke and a rearward intake stroke;

c. a valve assembly mounted at a forward end of said cylinder section and providing at least a fluid outlet leading from said cylinder chamber, said valve assembly comprising a valve body member having a rear portion in sealing engagement with a forward portion of said cylinder section, and a forward portion in sealing engagement with said end section of the housing structure;

d. said valve body and said end section forming a high pressure valve chamber located at a forward side of said valve body and arranged to receive high pressure fluid from said cylinder chamber;

e. said valve body having a forward fluid pressure surface means with an effective first rearwardly acting pressure surface area exposed to pressure from fluid in said valve chamber, and a second rear fluid pressure surface means with an effective second forwardly acting pressure surface area exposed to pressure from fluid in said cylinder chamber;

f. said first rearwardly acting pressure surface area being greater than said second forwardly acting pressure surface area in a manner that a net rearward pressure force is exerted on said valve body to cause said valve body to be urged into sealing engagement with said cylinder section; and g. a forward seal member located at an interface of the forward portion of the valve body and the end section of the housing structure, said forward seal member being arranged so that fluid pressure in said valve chamber acts on said forward seal member to tend to move the forward seal member into sealing engagement between said valve body and said end section of the housing structure.

2. The pump assembly as recited in claim 1, comprising a rear seal member at an interface of said cylinder section and the rear portion of the valve body, said rear seal member having first and second rear contact surfaces to engage said cylinder section and said valve body, respectively, with said rear contact surfaces being arranged so that a rearwardly directed force on said valve body tends to press said rear seal member into sealing engagement between said cylinder section and said valve body.

3. The pump assembly as recited in claim 2, wherein at least one of said first and second rear contact surfaces is slanted at an acute angle with said longitudinal axis.

4. The pump assembly as recited in claim 3, wherein the first rear contact surface of said rear seal member engages a matching slanted contact surface provided at a forward inner edge region of said cylinder section.

5. The pump assembly as recited in claim 4, wherein the second rear contact surface of the said rear seal has at least one surface portion thereof slanted at an acute angle with respect to said longitudinal axis and engages a matching surface of the rear portion of the valve body.

6. The pump assembly as recited in claim 5, wherein said second rear contact surface has, in a cross-sectional peripheral configuration, a curved surface configuration which engages a matching curved surface configuration of said rear portion of the valve body.

7. The pump assembly as recited in claim 3, wherein the second rear contact surface of the said rear seal has at least one surface portion thereof slanted at an acute angle with respect to said longitudinal axis and engages a matching surface of the rear portion of the valve body.

8. The pump assembly as recited in claim 7, wherein said second rear contact surface has, in a cross-sectional peripheral configuration a curved surface configuration which engages a matching curved surface configuration of said rear portion of the valve body.

9. The pump assembly as recited in claim 7, wherein said rear seal is made of a nongalling material which permits limited relative movement at said contact surfaces without substantial galling.

10. The pump assembly as recited in claim 3, wherein said rear seal is made of a nongalling material which permits limited relative movement at said contact surfaces without substantial galling.

11. The pump assembly as recited in claim 1, wherein said forward seal member has a forwardly facing effective seal surface area exposed to pressurized fluid in said valve chamber, whereby fluid pressure in said valve chamber exerts a rearward force on said forward seal member to cause said forward seal member to come into effective sealing engagement.

12. The pump assembly as recited in claim 11 wherein said forward seal member has first and second forward contact faces to engage matching forward contact surface portions of said valve body and said end section, respectively, one of said first and second forward contact faces being slanted at an acute angle with respect to said longitudinal axis.

13. The pump assembly as recited in claim 12, wherein said first forward contact face is slanted at said acute angle, and said valve body has its said forward contact surface portion sloped forwardly and inwardly to match the first forward contact surface of the forward seal member.

14. The seal assembly as recited in claim 13, wherein the second contact forward face of the forward seal member faces radially outwardly, and the forward contact surface portion of the end section faces radially inwardly to match the second forward contact surface of the forward seal member.

15. The pump assembly as recited in claim 14, wherein said second forward contact face of the forward seal member is substantially parallel to said longitudinal axis.

16. The pump assembly as recited in claim 11, further comprising a spacing element positioned in said valve chamber and disposed to bear against a forwardly facing surface portion of said forward seal member.

17. The pump assembly as recited in claim 1, wherein said valve body and said end section of the housing structure are arranged to provide a passageway means extending rearwardly from said forward seal member to a low pressure area, whereby leakage around said forward seal member can escape through said passageway means.

18. The assembly as recited in claim 17, wherein said valve body has a forward inwardly and forwardly tapering facing frusto-conical surface which engages said forward seal member and which is spaced from said end section at a location forwardly of said forward seal member to provide said passageway means.

19. The assembly as recited in claim 1, wherein said forward seal member is made of a nongalling material to permit limited relative movement between said end section and said valve body without substantial galling.

20. The assembly as recited in claim 1, wherein said valve body is formed with an outlet passageway portion leading from said cylinder chamber, said valve assembly comprising a poppet valve element, and an annular poppet seat element positioned forwardly of said poppet valve element, and located in a recess at a forward portion of said valve body, said poppet valve element being positioned against said poppet seat element when the poppet valve element is in its closed position, said poppet seat element having a radially outward surface portion exposed to pressure in said valve chamber, whereby fluid pressure in said valve chamber is able to exert a radially inward compressive force on said poppet seat element to balance radially outwardly exerted fluid pressure forces from within said passageway outlet portion.

21. The pump assembly as recited in claim 20, wherein said poppet seat element has a generally cylindrical configuration.

22. The high pressure pump assembly as recited in claim 1, further comprising a rear seal member at an interface of said cylinder section and the rear portion of the valve body, said rear seal member having first and second rear contact surfaces to engage said cylinder section and said valve body, respectively, with said rear contact surfaces being arranged so that a rearwardly directed force on said valve body tends to press said rear seal member into sealing engagement between said cylinder section and said valve body.

23. The high pressure pump assembly recited in claim 22, comprising:

a. at least one of said first and second rear contact surface is slanted at an acute angle with said longitudinal axis.

b. said forward seal member has a forwardly facing effective seal surface area exposed to pressurized fluid in said valve chamber, whereby fluid pressure in said valve chamber exerts a rearward force on said forward seal member to cause said forward seal member to come into effective sealing engagement.

c. said forward seal member has first and second forward contact faces to engage matching forward contact surface portions of said valve body and said end section, respectively, one of said first and second forward contact faces being slanted at an acute angle with respect to said longitudinal axis.

24. A high pressure pump assembly comprising:

a. a housing structure having a forward end, a rear end, a longitudinal center axis, and comprising a rear cylinder section defining a high pressure longitudinally aligned cylinder chamber, and a forward end section;

b. a piston mounted for reciprocating motion in said cylinder chamber on a forward high pressure discharge stroke and a rearward intake stroke;

c. a valve assembly mounted at a forward end of said cylinder section and providing at least a fluid outlet leading from said cylinder chamber, said valve assembly comprising a valve body member having a rear portion in sealing engagement with a forward portion of said cylinder section, and a forward portion in sealing engagement with said end section of the housing structure;

d. said valve body and said end section forming a high pressure valve chamber located forwardly of said valve body and arranged to receive high pressure fluid from said cylinder chamber;

e. a rear seal member at an interface of said cylinder section and the rear portion of the valve body, said rear seal member having first and second rear contact surfaces to engage said cylinder section and said valve body, respectively, with said rear contact surfaces being arranged so that a rearward force on said valve body tends to press said rear seal member into sealing engagement between said cylinder section and said valve body.

25. The pump assembly as recited in claim 24, wherein at lest one of said first and second rear contact surfaces is slanted at an acute angle with said longitudinal axis.

26. The pump assembly as recited in claim 25, wherein the first rear contact surface of said rear seal member engages a matching slanted contact surface provided at a forward inner edge region of said cylinder section.

27. The pump assembly as recited in claim 26, wherein the second contact rear surface of the said rear seal has at least one surface portion thereof slanted at an acute angle with respect to said longitudinal axis and engages a matching surface of the rear portion of the valve body.

28. The pump assembly as recited in claim 27, wherein said second rear contact surface has, in a cross-sectional peripheral configuration a curved surface configuration which engages a matching curved surface configuration of said rear portion of the valve body.

29. The pump assembly as recited in claim 25, wherein the second rear contact surface of the said rear seal has at least one surface portion thereof slanted at an acute angle with respect to said longitudinal axis and engages a matching surface of the rear portion of the valve body.

30. The pump assembly as recited in claim 29, wherein said second rear contact surface has, in a cross-sectional peripheral configuration a curved surface configuration which engages a matching curved surface configuration of said rear portion of the valve body.

31. The pump assembly as recited in claim 29, wherein said rear seal is made of a nongalling material which permits limited relative movement at said contact surfaces without substantial galling.

32. The pump assembly as recited in claim 25, wherein said rear seal is made of a nongalling material which permits limited relative movement at said contact surfaces without substantial galling.

33. The pump assembly as recited in claim 24, further comprising a forward seal member located at an interface of the forward portion of the valve body and the end section of the housing structure, said forward seal member being arranged so that fluid pressure in said valve chamber acts on said forward seal member to tend to move the forward seal member into sealing engagement between said valve body and said end section of the housing structure.

34. The pump assembly as recited in claim 33, wherein said forward seal member has a forwardly facing effective seal surface area exposed to pressurized fluid in said valve chamber, whereby fluid pressure in said valve chamber exerts a rearward force on said forward seal member to cause said forward seal member to come into effective sealing engagement.

35. The pump assembly as recited in claim 34, wherein said forward seal member has first and second forward contact faces to engage matching contact surface portions of said valve body and said end section, respectively, one of said first and second contact faces being slanted at an acute angle with respect to said longitudinal axis.

36. A high pressure pump assembly comprising:

a. a housing structure having a forward end, a rear end, a longitudinal center axis, and comprising a rear cylinder section defining a high pressure longitudinally aligned cylinder chamber, and a forward end section;

b. a piston mounted for reciprocating motion in said cylinder chamber on a forward high pressure discharge stroke and a rearward intake stroke;

c. a valve assembly mounted at a forward end of said cylinder section and providing at least a fluid outlet leading from said cylinder chamber, said valve assembly comprising a valve body member having a rear portion in sealing engagement with a forward portion of said cylinder section, and a forward portion with a forward and inwardly tapering forward contact surface in sealing engagement with said end section of the housing structure;

d. said valve body and said end section forming a high pressure valve chamber located forwardly of said valve body and arranged to receive high pressure fluid from said cylinder chamber;

e. a forward seal member located at an interface of the forward contact surface of the valve body and the end section of the housing structure, said forward seal member being arranged so that fluid pressure in said valve chamber acts on said forward seal member to tend to move the forward seal member into sealing engagement between the forward contact surface of said valve body and said end section of the housing structure.

37. The pump assembly as recited in claim 36, wherein said forward seal member has a forwardly facing effective seal surface area exposed to pressurized fluid in said valve chamber, whereby fluid pressure in said valve chamber exerts a rearward force on said forward seal member to cause said forward seal member to come into effective sealing engagement.

38. The pump assembly as recited in claim 37, wherein said forward seal member has first and second forward contact faces to engage said forward contact surface portions of said valve body and a forward contact surface of said end section, respectively, said first forward contact face being slanted at an acute angle with respect to said longitudinal axis.

39. The seal assembly as recited in claim 38, wherein the second forward contact face of the forward seal member faces radially outwardly, and the contact surface portion of the end section faces radially inwardly to match the second forward contact surface of the forward seal member.

40. The pump assembly as recited in claim 39, wherein said forward second contact face of the forward seal member is substantially parallel to said longitudinal axis.

41. The pump assembly as recited in claim 37, further comprising a spacing element positioned in said forward valve chamber and disposed to bear against a forwardly facing surface portion of said forward seal member.

42. The pump assembly as recited in claim 36, wherein said valve body and said end section of the housing structure are arranged to provide a passageway means extending rearwardly from said forward seal member to a low pressure area, whereby leakage around said forward seal member can escape through said passageway means.

43. The assembly as recited in claim 42, wherein said forward contact surface of said valve body is a forward facing frusto-conical surface which engages said forward seal member and which is spaced from said end section at a location rearwardly of said forward seal member to provide said passageway means.

44. The assembly as recited in claim 36, wherein said forward seal member is made of a nongalling material to permit limited relative movement between said end section and said valve body without substantial galling.

45. The assembly as recited in claim 36 wherein said valve body is formed with an outlet passageway portion leading from said cylinder chamber, said valve assembly comprising a poppet valve element, and an annular poppet seat element positioned forwardly of said poppet valve element, and located in a recess at a forward portion of said valve body, said poppet valve element being positioned against said poppet seat element when the poppet valve element is in its closed position, said poppet seat element having a radially outward surface portion exposed to pressure in said valve chamber, whereby fluid pressure in said valve chamber is able to exert a radially inward compressive force on said poppet seat element to balance radially outwardly exerted fluid pressure forces from within said passageway outlet portion.

46. The pump assembly as recited in claim 45, wherein said poppet seat element has a generally cylindrical configuration.

* * * * *